United States Patent [19]

Eagles

[11] 4,315,533

[45] Feb. 16, 1982

[54] TRANSFER SYSTEMS

[75] Inventor: Geoffrey J. Eagles, Meopham, England

[73] Assignee: GEC Mechanical Handling Limited, Wiltshire, England

[21] Appl. No.: 24,884

[22] Filed: Mar. 29, 1979

[30] Foreign Application Priority Data

Jun. 30, 1978 [GB] United Kingdom ..... 28427/78

[51] Int. Cl.[3] ..... B65B 3/04; B67D 5/00

[52] U.S. Cl. ..... 141/387; 137/615

[58] Field of Search ..... 137/615; 141/279, 284, 141/387, 388

[56] References Cited

U.S. PATENT DOCUMENTS

| | | | |
|---|---|---|---|
| 3,721,260 | 3/1973 | Stahmer | 137/615 X |
| 3,921,557 | 11/1975 | Kapteijn et al. | 141/387 X |
| 4,121,616 | 10/1978 | Lochte et al. | 141/387 |

*Primary Examiner*—Frederick R. Schmidt

*Attorney, Agent, or Firm*—Kirschstein, Kirschstein, Ottinger & Cobrin

[57] ABSTRACT

An arrangement for establishing a mechanical connection between two relatively movable structures, such as a fixed or floating marine structure and a vessel for facilitating the transfer of things between them has a double boom assembly carried by a support rotatably mounted on one said structure for enabling the boom assembly to be slewed about a generally vertical axis, the double boom assembly comprising a main boom pivotal on the support so that it can be raised or lowered, and an auxiliary boom pivotal on a trolley movable along the main boom, and, coupling means connecting the outer end of the auxiliary boom to co-operating means of a second structure, and including a universal joint which permits movement between the second structure and the boom assembly. The arrangement can be used for transferring liquids, the auxiliary boom in such a case accommodating at least one pipe having, at the outer end of the boom, coupling means for connection to a co-operating pipe on the second structure, and being connected at the inner end of the boom to a system of swivelling pipes by which the pipe can be coupled to a further pipe on the first structure. Such an arrangement can provide an all metal flow path which makes it suitable for transferring liquid gas while accommodating various movements of the tanker relative to the mooring structure.

16 Claims, 3 Drawing Figures

TRANSFER SYSTEMS

This invention relates to arrangements for establishing a mechanical connection between two relatively movable structures to facilitate the transfer of articles, liquid or personnel between them, and relates more especially, though not exclusively, to such arrangements for use in linking a tanker or other vessel to a floating or fixed marine structure.

According to one aspect of the invention an arrangement for establishing a mechanical connection between two relatively movable structures comprises a double boom assembly carried by a support which is rotatably mounted on one said structure for enabling the boom assembly to be slewed about a generally vertical axis, the double boom assembly comprising a main boom pivotably carried by the support so that it can be raised and lowered, and an auxiliary boom carried by a trolley which is capable of axial movement along the main boom, and, at the outer end of the auxiliary boom, a coupling means for connecting said end of the auxiliary boom to co-operating coupling means of the other structure and incorporating or associated with a universal joint which permits a degree of movement between the second structure and the boom assembly.

The first said structure may, for example be a mooring structure for marine vessels, the invention providing a means of establishing a mechanical connection between the structure, which may be either fixed or floating, and a said vessel, for facilitating the transfer of supplies or personnel between them, whilst accommodating movement of the vessel relative to the mooring structure caused, for example, to wave motion or the effect of wind and/or tides.

The invention has particular application to arrangements for transferring liquids between two relatively moving structures, and especially, though not exclusively for the loading of liquid gas tankers from floating or fixed marine structures.

According, therefore, to another aspect of the invention, an arrangement for transferring liquid between two relatively moving structures has a double boom assembly carried by a support which is rotatably mounted on one said structure for enabling the boom assembly to be slewed about a generally vertical axis, the double boom assembly comprising a main boom pivotably carried by the support so that it can be raised and lowered, and an auxiliary boom pivotably carried by a trolley which is capable of axial movement along the main boom, the auxiliary boom accommodating at least one pipe having, at the outer end of the boom, coupling means incorporating a universal joint for connection to co-operating coupling means of a second structure, and connected at the inner end of the boom to a system of swivelling pipes by which it is coupled to further pipes of the first structure.

Such an arrangement has the advantage that it avoids the need for flexible pipes, which are generally unsuitable for use at cryogenic temperatures, the use of metal pipes and swivelling couplings therefor, which can be designed in a manner suitable for conveying liquids at such temperatures, enabling the arrangement to be used for transferring liquid gas from a mooring structure to a tanker whilst at the same time accommodating various movements of the tanker relative to the mooring structure.

According, therefore, to a further aspect of the invention, an arrangement for transferring liquid gas from a mooring structure to a tanker has a double boom assembly carried by a support which is rotatably mounted on the mooring structure for enabling the boom assembly to be slewed about a generally vertical axis, the double boom assembly comprising a main boom pivotally carried by the support so that it can be raised or lowered and, beneath the main boom, an auxiliary boom carried by a trolley which is capable of movement along the main boom, the auxiliary boom carrying at least one pipe for conveying liquid gas, which pipe is connected at the outer end of the boom to coupling means incorporating a universal joint for connection to co-operating coupling means of the tanker, and at the inner end of the boom to a system of swivelling pipes, by which it is coupled to further pipes of the mooring structure.

It will, of course, be understood that the pipes and couplings of such an arrangement, including the swivelling couplings, should be of a kind suitable for conveying liquid at cryogenic temperature.

Conveniently the suport is rotatably mounted on a carrier which is movable along a predetermined path on said mooring structure, and in the case of an arrangement for transferring liquids the mooring structure has at least one pipe terminating in a first coupling member at a fixed position on the structure, and part of the system of swivelling pipes carried by the support and/or carrier member terminates in a second coupling member and is such that when the second coupling member is connected to the first coupling member it permits the carrier member and support to be moved along said path at least to a limited extent.

The carrier may be constrained to move around a circular path on the mooring structure, and in a liquid transfer arrangement the mooring structure preferably has a plurality of pipes terminating in respective first coupling members at spaced positions around it, and the carrier and support being movable around said path to positions in which the second coupling member can be connected to any selected one of said first coupling members. By this means a tanker coupled to the pipe or pipes at the end of the auxiliary boom, is able to move around the mooring structure depending upon the weather and sea conditions, any movement greater than that which can be accommodated solely by the swivelling pipe system being possible by disconnecting the second coupling member from the first coupling member to which it is connected, and reconnecting it to an appropriate one of the other first coupling members.

For the transferrence of liquid the auxiliary boom conveniently accommodates two pipes providing twin flow paths, each of which is connected at the outer end of the auxiliary boom to a respective coupling member for connection to a co-operating one of a pair of coupling members on a tanker, and at the inner end of the auxiliary boom to a respective system of swivelling pipes each terminating in a coupling member by which it can be connected to a respective coupling member on the mooring structure.

In such an arrangement the twin flow paths may be used respectively for the conveyance of the liquid gas from the mooring structure to a tanker and as a tank-to-tank pressure line; however it will be appreciated that by utilising an appropriate number of pipes and swivelling pipe systems, triple, quadruple or other different numbers of flow paths could be accommodated. The pipe or pipes of the auxiliary boom may provide a structural part of structural parts of the boom.

Preferably the part of the swivelling pipe system between each said auxiliary boom pipe and a connection on the support comprises a plurality of straight lengths of pipe joined by swivelling couplings in a zig-zag fashion, and at least some of the lengths of pipe are pivotally supported intermediate their ends on respective trolleys movable axially along the main boom.

The or each said swivelling pipe system conveniently terminates at its outer end at the main trolley which provides the pivotal support for the auxiliary boom.

The auxiliary boom in any of the arrangements above described is also conveniently supported intermediate its ends by a cable and pulley system, the system incorporating one or more lower pulleys at a fixed position on the auxiliary boom, and one or more upper pulleys carried by a further trolley supported by the main boom and movable axially along it at a fixed distance outwardly from the main trolley.

Preferably the support system is such as to bias the auxiliary boom upwards towards the main boom, the connection of the coupling member or members at the outer end of the auxiliary boom to the co-operating coupling member or members of a tanker or other vessel being arranged holding the auxiliary boom down against the upward bias.

The support system is preferably so arranged that if the downward force applied at the outer end of the auxiliary boom remains substantially constant the angular position of the auxiliary boom relative to the main boom is also maintained substantially constant despite movement of the main and further trolleys axially along the main boom.

The main boom may be arranged to be raised and lowered as required by means of a crane mounted on, but rotatable with respect to, the boom support, so that it can be independently utilised for general purposes when not needed to move the boom.

The universal joint at the outer end of the auxiliary boom is conveniently in the form of a Hooke's Joint. In the case of a liquid transfer arrangement the pipe or pipes at the outer end of the auxiliary boom may be coupled through said universal joint to a downward extension which terminates in a coupling member or coupling members, as the case may be, for connection to the co-operating coupling member or members of a tanker, the extension conveniently also incorporating a rotary coupling. The co-operating coupling member or members of the tanker are preferably also coupled to fixed pipework on the tanker through a universal joint.

BRIEF DESCRIPTION OF DRAWINGS

One embodiment of the invention is shown in FIGS. 1 to 3 of the accompanying drawing. In this application of the invention the liquid gas transfer system is shown as being carried from a floating buoy structure and is in use for the transfer of liquid gas to a tanker vessel specially adapted for the purpose.

Referring first to FIG. 1, the system consists of a travelling unit A supported from and movable around a pair of concentric circumferential rails B, bogie assemblies C and D being provided for this purpose. A further concentric rail system E is also provided for the support and guidance of a trolley F which supports coupling members G and H which are arranged to connect with sockets J located in pairs at suitable circumferential intervals immediately inbaord of the rail E. The coupling members G and H are coupled to the main structure of the travelling unit A by means of articulated arms K each of which consists of an arrangement of pipes and swivels L designed specifically for the conveyance of liquids at cryogenic temperatures and well known to those versed in the art. By these means adjustable dual connections are made from the fixed buoy M to the travelling unit A such that the latter may rotate freely relative to the former in the order of $\pm 50°$ in plan rotation relative to a given pair of sockets J. In this way it is possible for the weathervaning of a tanker vessel N in relation to the buoy M to be accommodated within these limits. Beyond the limit of 100° accommodation, it is necessary for the coupling members G and H to be withdrawn from a given pair of sockets J and, by means of the trolley F running on the rail E, to be traversed around to another more suitably located pair of sockets J.

Figure 1:
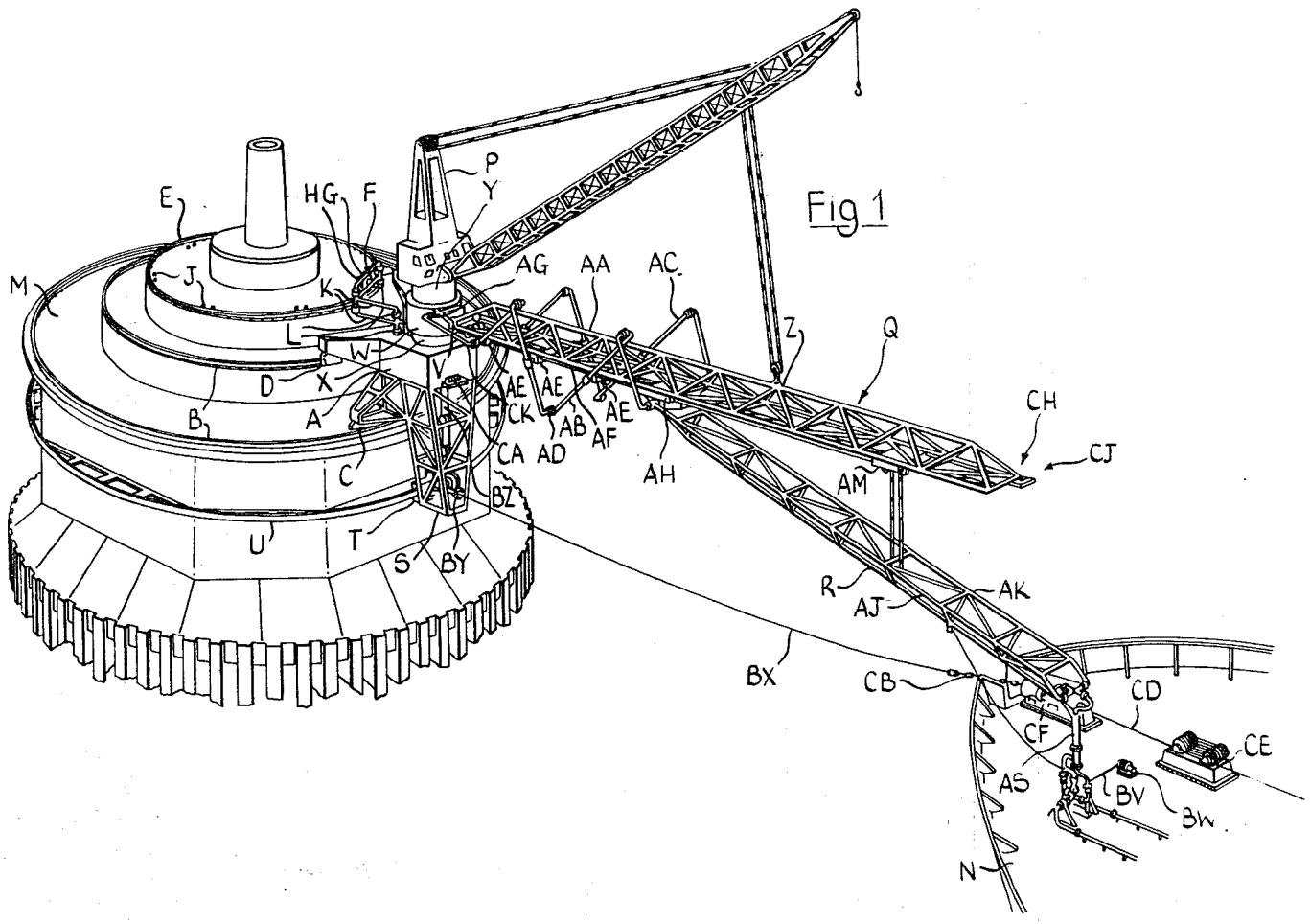

In the liquid gas transfer system illustrated on the drawing, twin flow paths are shown and typically these may be used respectively for the conveyance of the liquid gas from the buoy M to the tanker vessel N and as a tank-to-tank pressure balance line, but systems of similar general layout could optionally be arranged employing single, triple or quadruple fluid flow paths.

The travelling unit A supports a crane P of standard construction, a double boom assembly Q,R and a structural tower unit S, which is connected to the underside of the main body of the travelling unit A and is horizontally located by further trolleys T carried from a fourth circumferential mooring reaction rail U.

The double boom assembly comprises a main boom Q which is pivotally located at the point V on a rotatable cylindrical structure W. This unit is attached to the main body of the unit A by a slewing ring located at the point X and is provided with a suitable drive (not shown) enabling the boom assembly Q,R to be slewed in plan relative to the main body of the unit A. Likewise the crane P is supported on a further slewing ring located at the point Y and similarly driven in the slewing sense. Thus by the combination of these slewing drives the crane P and the boom assembly Q,R may be rotated in plan in synchronism or independently and such that the crane may be utilised for its primary purpose of supporting the main boom at the point Z or independently for general purposes. In this latter case parking means (not shown) are provided for the boom assembly Q,R when not in use.

Figure 2:
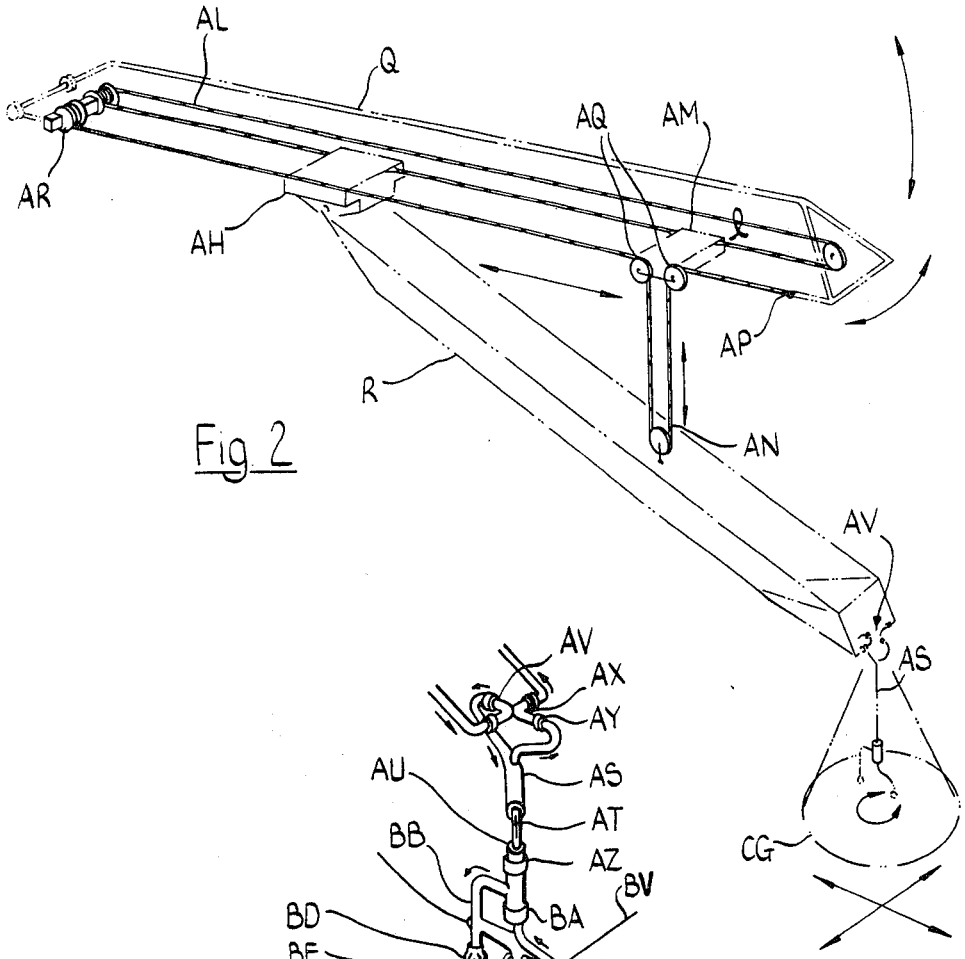
Figure 3:
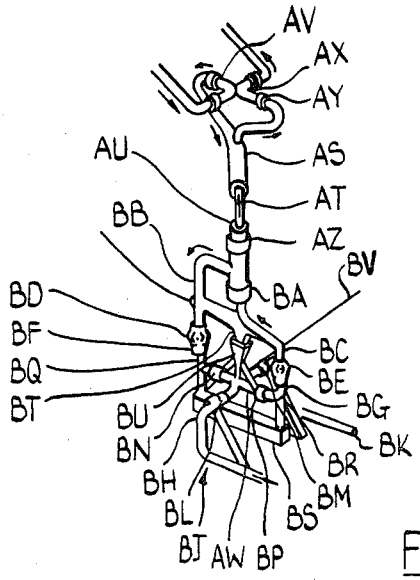

The main boom Q is typically constructed of steel tubes or sections and is triangular in cross section having a single tube or member AA forming its upper edge. Carried from the main boom structure Q are typically a pair of walking pipe assemblies AB, AC. These consist of straight lengths of tube arranged in a zig-zag or "lazy-tongs" fashion interconnected by swivels AD, similar to the swivels L previously described, with some of the straight lengths of tube pivotally connected to travelling trolleys AE which are supported from, and are able to move in an axial direction relative to, the boom Q via a suitable arrangement of rollers and rails AF supported from the lower members of the structural frame of the main boom Q. The lazy-tong assemblies have their point of origin on the slewing unit W at points AG placed adjacent to the main boom pivots V. The lazy-tong walking pipe assemblies terminate at their outer ends at a travelling trolley AH which also provides pivotal support for the auxiliary or linking boom R of the boom assembly. In this case the boom structure is also of triangular section the single member being located at the lower edge. In the case of this linking boom R the fluid flow paths AJ and AK are the structural tubes forming the upper side of the triangular boom construction. However, optionally, the linking boom R may alternatively be arranged to afford structural support for independent pipes forming the fluid flow paths. The trolley AH which supports the inner end of the linking boom R shares common rails AF with the walking pipe trolleys AE and may be driven axially along the main boom Q by a suitable drive system AL. This system may typically consist of a winch and endless rope arrangement and allows the trolley AH and a further trolley AM to be driven in constant axial relationship backwards or forwards along the length of the main boom Q within limits proscribed by the length of the latter. The linking boom R is supported towards its outer end by a further rope system AN which has a fixed point AP at or near to the outer end of the main boom Q this rope system passing over pulleys AQ attached to the trolley AM and hence passing back to a winch AR which may typically be powered by a constant torque power source, for example a combination of hydraulic motor and pump, the latter operating under constant pressure conditions. This drive AR is preferably operated in such a way that the linking boom R will at all times be biased in an upward direction by the roping system AN. That is to say if the tanker vessel end of the linking boom R should be released it would automatically rise to an attitude parallel with that of the main boom Q. The arrangement of the roping system AN (FIG. 2) is such that when the trolleys AH and AM are traversed backwards or forwards along the length of the main boom Q by the rope system AL the angular attitude of the linking boom R relative to the main boom Q remains constant assuming that a vertical downward force is being applied at the outer end of the linking boom R via the swivelling tanker connection assembly AS (FIG. 3).

This connection assembly unit provides a pair of concentric flow paths AT and AU and is built up in the form of a pair of Hooke's Joints AV and AW each of which is constructed from pipe bends AX and swivels AY similar to those used at AD and L. This twin Hooke's Joint Assembly is arranged by means of further swivel assemblies AZ and BA in the essentially vertical leg such that relative rotation in plan between the upper Hooke's Joint AV and the lower Hooke's Joint AW may take place. This double swivel AZ, BA separates the two flow paths at BB and BC, these paths being terminated by coupling probes of known design at BD and BE. These co-operate with receivers BF and BG which form part of the ship mounted assembly which also includes the lower Hooke's Joint AW. This ship mounted assembly consists of a pair of suitable brackets one of which is indicated at BH, these providing the fixed shipboard ends of the flow paths indicated at BJ and BK. Hence the shipboard Hooke's Joint Assembly is connected to the ship's structure by two of the swivels which form part of the lower Hooke's Joint and are indicated at BL and BM. In the embodiment disclosed the axis of this rotatable location between the lower Hooke's Joint and the ship's structure is shown lying in a plane at right angles to the mid-line of the ship. Likewise the opposing pair of swivels of the lower Hooke's Joint Assembly which are indicated at BN and BP and which lie in a plane parallel to the mid-line of the ship provide the terminations for the receivers BF and BG via pipe bends BQ and BR. To these pipe bends BQ and BR is connected a common stabilising or counterweight BS which may optionally be damped by hydraulic or other means not disclosed and which serves to maintain the shipboard Hooke's Joint Assembly in a sensibly vertical attitude against the rolling and pitching motions of the ship.

A further feature of the connecting arrangements is the guide assembly used during the initial connecting up process. This consists of a tapered probe BT of square section attached at the lower end of the vertical assembly carried from the end of the linking boom R. This is arranged to co-operate with a roller box assembly BU attached to the shipborne Hooke's Joint Asembly. A rigging line BV is connected at the extreme point of the probe BT and passes downwards through the roller box round a pulley not shown and across to a downhaul winch BW.

The Tanker Mooring System is housed in the tower structure S and consists of a main mooring cable BX which passes through a fairlead BY over a (typically) 4:1 jigger system BZ and terminates at the buoy end at a winch CA. The jigger BZ is connected to a system of hydraulic accumulators and compressed air cylinders (not shown) the whole constituting a spring system arranged (typically) to "bottom" at a hawser tension of 175/200 tons. At the ship end the hawser is terminated with a chaffing chain CB and a cylindrical stop member (not shown). The stop is in turn connected to a rigging line CD which is hauled by a winch CE mounted in the bows of the tanker and located adjacent to a stopper/-fairlead assembly CF of known design.

From the foregoing description it will be apparent to those versed in the art that the function of the two Hooke's Joints AV and AW which constitute respectively the upper and lower ends of the swivelling tanker connection assembly AS is to permit limited but free motion by the tanker vessel relative to the end of the linking boom R in all plan directions as indicated by the circle CG on the diagrammatic illustration. The upward biasing of the linking boom R by the rope and winch system AN, AR ensures that the connecting assembly AS remains, while in operation, in a suitable condition of tension and hence enables vertical movements of the bows of the ship to be compensated for by rotation of the linking boom R relative to its supporting trolley AH. If it is necessary to permit fore and aft movements of the tanker vessel greater than is permissible by the rotation of the upper and lower Hooke's Joint Assemblies about the axes at right angles to the mid-line of the tanker vessel such motions may be accommodated by axial movement of the linking boom support trolley AH relative to the main boom Q and likewise horizontal movements of the bows of the vessel in a direction essentially at right angles to the mid-line of the vessel which cannot be accommodated by rotation of the Hooke's Joints about the axes parallel to the mid-line of the vessel are accommodated by rotational traversing of the entire loading boom/mooring structure about the vertical centre line of the buoy, such motions being accomplished by the traversing of the structure supported on the concentric rail systems B. Alternatively and to a strictly limited extent, a transverse to the mid-line excursion of the bow of the vessel may be accommodated by synchronised rotation of the crane P and main boom Q making use of the slewing ring and slewing drive located at the point X.

The accommodation of tanker vessels of varying draft may be accomplished by the setting of the main boom Q at a suitable angle by means of the crane P while the accommodation of the change in draft of any given tanker which will occur between the ballasted and fully laden conditions may be accomplished by changing the angle of the main boom Q or that of the linking boom R or by a combination of these motions as may be most convenient.

A typical rigging sequence will now be described by way of example and in further clarification of the mode of operation of the invention. During the preparatory phase the entire rotating structure is located in a plan angular position on the buoy such as to provide the most favourable approach angle for the tanker vessel having due regard to the prevailing wind and current vectors. Likewise the angle of the main boom Q is chosen such as to be most suitable for the ballasted draft of the oncoming tanker vessel. At this stage the linking boom R will be retained in its position parallel with the main boom Q by means of the rope/winch system AN, AR. The connecting assembly AS will be hanging vertically downwards from the end of the linking boom R and the rigging line BV will be loosely looped back and secured to the small rigging platform CH. This rigging platform is equipped with a compressed air operated line firing gun CJ of known design and upon the approach of the tanker this is used to fire a light line on to the bow of the tanker and in turn the light line is used to transfer from the rigging platform to the tanker a pair of heavier pilot lines. The first of these pilot lines is at the rigging platform end connected to the line which terminates at the end of the probe BT and hence upon coming to hand in the bow of the tanker is used to transfer the probe pilot line to the tanker where it is connected to a line which has already been passed from the downhaul winch BW upwards through the roller box BU. In this way a connection is made which can at the appropriate stage in the mooring procedure be used to haul the probe BT downwards into the roller box BU and in the process connecting the two flow paths by means of the proprietary probe/receiver assemblies BD, BF and BE, BG. Likewise the second pilot line when it comes to hand in the bow of the tanker is connected to the mooring haulage line CD. This second pilot line has already been terminated at the buoy end on a short line which is connected to the stop which terminates the chaffing chain CB. Thus by means of the second pilot line the haulage line CD may be connected to the short line this operation taking place in the general area of the point CK. Upon making this connection the mooring haulage winch CE may be used to draw the main mooring cable BX together with the chaffing chain CB and the end stop across to the tanker vessel by means of the haulage line CD, this having been previously threaded through the panama fairlead which forms part of the stopper unit CF. Upon arrival at the tanker bows the stop on the end of the chaffing chain CB is latched into the stopper unit and the mooring operation is complete. Next the distance between the bow of the vessel and the buoy structure may, if necessary, be adjusted by means of the winch CA. In the next stage of the operation any necessary adjustments are made to the angle of the main boom Q by means of the crane P and to the longitudinal position of the linking boom trolley AH by means of the rope/winch system AL. The probe BT will now be positioned immediately above the roller box BU and the line BV will be passing down from it through the roller box BU to the downhaul winch BW and in the next phase of the operation the probe is drawn down against the upward bias of the linking boom R such that the connections of the flow paths BD BF and BE BG are both achieved.

The twin flow paths between the buoy and the tanker vessel are now established and typically these may, as previously explained, be employed one for the transfer of liquid gas from the buoy to the tanker vessel and one for pressure balancing purposes between the vessel and buoy tank systems. However, the twin flow paths may also be made use of in a variety of alternative modes.

Moreover although the invention has particular application to the transfer of liquid gas between a mooring structure, which may be in the form of a floating body, such as a buoy, or a fixed structure supported, for example, on the sea bed, and a tanker, it will be appreciated that it can have other applications where liquid is required to be transferred between two relatively movable structures without the use of flexible pipes.

Equally it will be understood by those versed in the art that the general structural concept disclosed in this specification is applicable to a number of purposes other than for the transfer of liquids. That is to say, in any circumstances where it is desired to establish a mechanical connection between a marine structure and a vessel which is subject to wind and wave induced motions producing relative movement between the connection point on the vessel and the marine structure. Hence, by way of example, the boom assembly disclosed could be used as a means of access for the conveyance of personnel or goods between the said marine structure and the said vessel. In such circumstances an assembly similar to that referenced AS in the accompanying drawing with a Hooke's Joint at either end, but without incorporating a liquid flow path or paths, provides a flexible structural connection between the end of the boom and the vessel such that the vessel motions are accommodated within prescribed limits in a similar manner to the embodiment previously described. In this alternative embodiment of the invention the initial connecting up procedure would be substantially as hereinbefore described, the lower Hooke's Joint of the vertical assembly AS being attached to the vessel's structure substantially in the manner disclosed.

I claim:

1. An arrangement for establishing a mechanical connection between two relatively movable structures comprising a double boom assembly carried by a support which is rotatably mounted on one said structure for enabling the boom assembly to be slewed about a generally vertical axis, the double boom assembly comprising a main boom pivotably carried by the support, so that it can be raised and lowered, and an auxiliary boom carried by a trolley which is capable of axial movement along the main boom, and, at the outer end of the auxiliary boom, a coupling means for connecting said end of the auxiliary boom to cooperating coupling means of the other structure and incorporating or associated with a universal joint which permits a degree of movement between the second structure and the boom assembly, and the auxiliary boom being supported intermediate its ends by a cable and pulley system, which system incorporates one or more lower pulleys at a fixed position on the auxiliary boom, and one or more upper pulleys carried by a further trolley supported by the main boom and movable axially along it at a fixed distance outwardly from the main trolley.

2. An arrangement for transferring liquid gas from a mooring structure to a tanker comprising a double boom assembly carried by a support which is rotatably mounted on the mooring structure for enabling the boom assembly to be slewed about a generally vertical axis, the double boom assembly comprising a main boom pivotally carried by the support so that it can be raised or lowered and, beneath the main boom, an auxiliary boom carried by a trolley which is capable of movement along the main boom, the auxiliary boom carrying at least one pipe for conveying liquid gas, which pipe is connected at the outer end of the boom to coupling means for connection to cooperating coupling means of the tanker, and at the inner end of the boom to a system of swivelling pipes, by which it is coupled to further pipes of the mooring structure, and the auxiliary boom being supported intermediate its ends by a cable and pulley system, which system incorporates one or more lower pulleys at a fixed position on the auxiliary boom, and one or more upper pulleys carried by a further trolley supported by the main boom and movable axially along it at a fixed distance outwardly from the main trolley.

3. An arrangement according to claim 2 wherein the support is rotatably mounted on a carrier which is movable along a predetermined path on said mooring structure, the mooring structure has at least one pipe terminating in a first coupling member at a fixed position on the structure, and part of the system of swivelling pipes carried by the support and/or carrier member terminates in a second coupling member and is such that when the second coupling member is connected to the first coupling member it permits the carrier member and support to be moved along said path at least to a limited extent.

4. An arrangement according to claim 3 wherein the carrier is constrained to move around a circular path on the mooring structure, the mooring structure has a plurality of pipes terminating in respective first coupling members at spaced positions around it, and the carrier and support are movable around said path to positions in which the second coupling member can be connected to different ones of the first coupling members.

5. An arrangement according to claim 4 wherein the auxiliary boom accommodates two pipes providing twin flow paths, each of which pipes is connected at the outer end of the auxiliary boom to respective coupling member for connection to a co-operating one of a pair of coupling members on a tanker, and at the inner end of the auxiliary boom to a respective system of swivelling pipes each terminating in a coupling member by which it can be connected to a respective coupling member on the mooring structure.

6. An arrangement according to claim 2 wherein the pipe or pipes which are accommodated by the auxiliary boom form a structural part or structural parts of the boom.

7. An arrangement according to claim 2 wherein the part of the system of swivelling pipes between each said auxiliary boom pipe and a connection on the support comprises a plurality of straight lengths of pipe jointed by swivelling couplings in a zig-zag fashion, and at least some of the lengths of pipe are pivotally supported intermediate their ends on respective trolleys movable axially along the main boom.

8. An arrangement for establishing a mechanical connection between two relatively movable structures comprising a double boom assembly carried by a support which is rotatably mounted on one said structure for enabling the boom assembly to be slewed about a generally vertical axis, the double boom assembly comprising a main boom pivotably carried by the support so that it can be raised and lowered, and an auxiliary boom carried by a trolley which is capable of axial movement along the main boom, and, at the outer end of the auxiliary boom, a coupling means for connecting said end of the auxiliary boom to cooperating coupling means of the other structure and incorporating or associated with a universal joint which permits a degree of movement between the second structure and the boom assembly, the auxiliary boom being supported intermediate its ends by a cable and pulley system, which system incorporates one or more lower pulleys at a fixed position on the auxiliary boom, and one or more upper pulleys carried by a further trolley supported by the main boom and movable axially along it at a fixed distance outwardly from the main trolley.

9. An arrangement according to claim 8 wherein the support is rotatably mounted on a carrier which is movable along a predetermined path on said one structure.

10. An arrangement according to claim 8 wherein the cable and pulley system biases the auxiliary boom upwards towards the main boom.

11. An arrangement according to claim 10 wherein the cable and pulley system is so arranged that if the downward force applied at the outer end of the auxiliary boom remains substantially constant the angular position of the auxiliary boom relative to the main boom is also maintained substantially constant despite movement of the main and further trolleys axially along the main boom.

12. An arrangement according to claim 8 wheren the coupling means for connecting the outer end of the auxiliary boom to coupling means of said other structure is carried by a downward extension which extension is connected to auxiliary boom by a said universal joint.

13. An arrangement according to claim 12 wherein the universal joint is in the form of a Hooke's Joint.

14. An arrangement according to claim 12 wherein the downward extension incorporates a rotary coupling.

15. An arrangement for establishing a mechanical connection between two relatively movable structures comprising a double boom assembly carried by a support which is rotatably mounted on one said structure for enabling the boom assembly to be slewed about a generally vertical axis, the double boom assembly comprising a main boom carried by the support, and an auxiliary boom which is pivotally supported at its inner end and is also capable of axial movement with respect to the main boom, and, at the outer end of the auxiliary boom, a coupling means for connecting said end of the auxiliary boom to cooperating coupling means of the other structure and carried by a downward extension connected to the auxiliary boom by a universal joint which permits a degree of movement between the second structure and the boom assembly, the auxiliary boom being supported intermediate its ends by a cable and pulley system controlling the pivoting movement of the auxiliary boom, the system incorporating one or more lower pulleys at a fixed position on the auxiliary boom, and one or more upper pulleys carried by the main boom.

16. An arrangement according to claim 15 wherein the cable and pulley system biases the auxiliary boom upwards towards the main boom, and is such that the connection of the coupling means at the outer end of the auxiliary boom to the cooperating coupling means of the other structure holds the auxiliary boom down against the upward bias.

* * * * *